US006333682B1

(12) United States Patent
Seely et al.

(10) Patent No.: US 6,333,682 B1
(45) Date of Patent: Dec. 25, 2001

(54) HIGH FREQUENCY LOW LOSS POWER AMPLIFIER COMBINER

(75) Inventors: Warren Leroy Seely, Chandler; Jay Chae Pyon, Gilbert, both of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/482,243

(22) Filed: Jan. 13, 2000

(51) Int. Cl.[7] ..... H01P 5/12
(52) U.S. Cl. ..... 333/128; 330/295
(58) Field of Search ..... 333/127, 128, 333/125; 330/124 D, 295

(56) References Cited

U.S. PATENT DOCUMENTS 4,272,740 * 6/1981 MacMaster et al. ..... 333/127
4,291,278 * 9/1981 Quine ..... 330/286
4,599,584 * 7/1986 Sasser et al. ..... 333/125
4,835,496 * 5/1989 Schellenberg et al. ..... 333/128
5,025,233 6/1991 Leonakis ..... 333/128
5,363,072 * 11/1994 Sakamoto et al. ..... 333/125
5,576,671 * 11/1996 Agar, Jr. et al. ..... 333/128
6,208,219 * 3/2001 Singer ..... 333/104

* cited by examiner

*Primary Examiner*—Justin P. Bettendorf
*Assistant Examiner*—Dean Takaoka
(74) *Attorney, Agent, or Firm*—Frank J. Bogacz; Jeff D. Limon

(57) ABSTRACT

A conductive element (FIG. 1, 220) incorporates a wide end portion (230) which is subdivided into a set of low impedance coupling paths (235) separated by one of the planar grooves (250). Each of the low impedance coupling paths (235) is suitable for coupling to a corresponding solid-state amplifier device (210). Power from each solid-state amplifier device (210) is combined at a narrow end portion (240) and conveyed to a transmission line (260). The high frequency low loss power combiner requires minimal integrated circuit chip area and can be designed and fabricated using existing microstrip analysis and design tools. Additionally, the substantially fully metallic structure provides additional excess heat dissipation through increased surface area over that of the Wilkenson power combiner. Further, due the broad conductive path formed by the conductive element, resistive losses are also minimized, thus increasing overall device efficiency.

8 Claims, 1 Drawing Sheet

HIGH FREQUENCY LOW LOSS POWER AMPLIFIER COMBINER

FIELD OF THE INVENTION

The invention relates generally to the field of high frequency electronics and, more particularly to high frequency low loss power amplifier combining structures.

BACKGROUND OF THE INVENTION

In a wireless communications system, a power amplifier is typically used in order to amplify a modulated communications signal prior to transmitting the signal through an antenna. When the power amplifier is placed within a portable wireless communications device, a group of solid-state amplifier devices can be used in order to provide the amplified signal. In this type of communications device, the output of each solid-state amplifier element is combined through the use of a high frequency power combining structure which provides a single output to the communications antenna. Thus, when designing a high frequency power amplifier combining structure, a premium is placed on the capability of the structure to combine signals with minimal loss.

In a conventional power combiner, such as a Wilkinson power combiner, a quarter wavelength section of transmission line is coupled to an output of each solid-state amplifier. At the opposite end of each quarter wavelength section, each transmission line is coupled to one or more similar quarter wavelength sections of transmission line in order to form a single output. In a multi-stage Wilkinson power divider, the combined output of two or more transmission lines is coupled to a second quarter wavelength section of transmission line. The output of these second lengths of transmission line is then combined into a single transmission line section. This method of combining successive stages continues until the outputs of all of the solid-state amplifier devices have been combined into a single output.

As each stage of a multi-stage Wilkinson power combiner requires a quarter wavelength section of transmission line, the length of the multi-stage power combiner can quickly become significant as the number of stages increases. Additionally, each quarter wavelength section of transmission line introduces a corresponding amount of resistive loss in signal strength. Further, as the multi-stage Wilkinson power combiner must generally transform the output impedance of each solid-state amplifier to a standard impedance value, such as 50 Ohms, high impedance sections of transmission line may be required as dictated by the particular impedance profile used to achieve the match. Typically, these high impedance sections further increase the loss of the multi-stage Wilkinson power combiner.

Thus, it is highly desirable for power combining structures to minimize loss, as well as reduce the required length of the structure. This would allow more efficient combining of power from solid-state amplifier devices as well as provide additional savings in the integrated circuit chip area required to perform the power combining function.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

DESCRIPTION OF THE PREFERRED EMBODIMENTS

A high frequency low loss power combiner enables the efficient power combining of solid-state amplifier devices through the use of a substantially full metal jacket combining structure. The power combiner requires minimal integrated circuit chip area and can be fabricated using existing microstrip design tools. Additionally, the substantially full metal jacket structure provides a low-resistance path for supplying direct current primary power to the amplifier devices, thereby increasing overall device efficiency. Further, the combiner provides additional excess heat dissipation through increased surface area of the conductive metallized structure over that of the Wilkenson power combiner.

Figure 1:
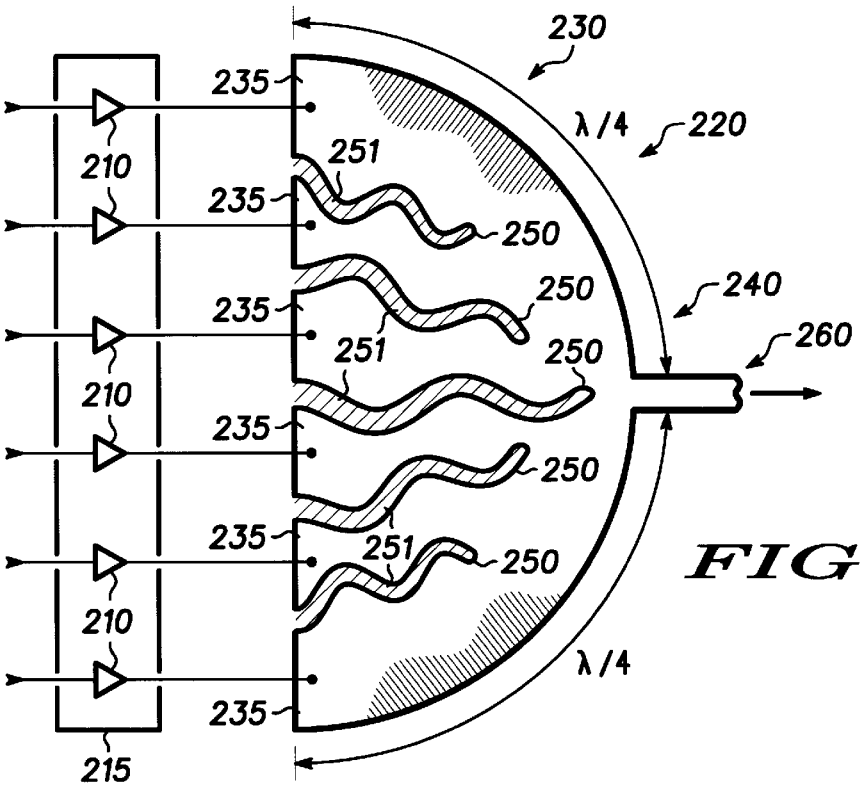
FIG. 1 is a layout of a high frequency low loss power combining structure in accordance with a preferred embodiment of the invention.

FIG. 1 is a layout of a high frequency low loss power combining structure in accordance with a preferred embodiment of the invention. Although the power combiner of FIG. 1 couples the outputs of six solid-state power amplifier elements into a single output, the present invention is not limited to 6:1 power combination, In alternate embodiments, the outputs of any number of solid-state power amplifier elements are combined into a single output. Preferably, the number of solid-state power amplifier elements which are combined into a single output is in the range of 2 to 10, although a greater number of outputs can be combined according to the requirements of the particular application as well as the integrated circuit chip area allotted for the power combining function.

In FIG. 1, solid-state amplifier devices 210 are arranged on die 215. Solid-state amplifier devices 210 may be constructed using any conventional type of amplifier device, such as field effect transistors, bipolar transistors, or other similar device. Additionally, the materials which comprise solid-state amplifier devices 210 can be any type of semiconductor such as Gallium Arsenide, Indium Phosphide, or other suitable material. The layout of FIG. 1 can be used in conjunction with any power amplifier circuit of a communications unit which makes use of solid-state amplifier devices.

An output of each of solid-state amplifier devices 210 is coupled to wide end portion 230 of conductive element 220. In a preferred embodiment, conductive element 220 is substantially planar and constructed of any type of metal used in high frequency circuit design. Thus, conductive element 220 may be formed using aluminum, copper, gold, or any other sufficiently conductive material. In a preferred embodiment, conductive element 220 is affixed to a dielectric layer such as Gallium Arsenide, Silicon Oxide or other type of on-die dielectric substrate material.

Conductive element 220 incorporates wide end portion 230 and narrow end portion 240. Wide end portion 230 desirably provides an interface to each of solid-state amplifier devices 210 through a corresponding one of coupling paths 235, while narrow end portion 240 provides an interface to output transmission line 260. Preferably, each of coupling paths 235 incorporates sufficient width for the purpose of coupling to each of solid-state amplifier devices 210 through a transmission line having a low characteristic impedance. Further, the considerable width of each of coupling paths 235 reduces the Ohmic losses of each signal from solid-state amplifier devices 210. Thus, through the use of substantially wide coupling paths, such as coupling paths 235, the high frequency low loss combining structure provides an acceptable match to the output impedance of each of solid-state amplifier devices 210 as well as a low loss signal path.

Narrow end portion 240 provides a smooth transition from the high frequency low loss power combining structure of FIG. 1 to output transmission line 260. In a preferred embodiment, output transmission line 260 possesses a characteristic impedance approximately equal to a standard value, such as 50 or 75 Ohms. However, nothing prevents the transition to a non-standard impedance value such as 100 Ohms, for example.

The general shape of conductive element 220 is shown in FIG. 1 as being semicircular with the distance along the outer perimeter from wide end portion 230 to narrow end portion 240 being one quarter wavelength. However, conductive element 220 can be shaped according to any suitable conic section. Therefore, conductive element 220 can be shaped as a portion of an ellipse, circle, or in accordance with any other conic section. It is expected that the general shape of conductive element 220 is determined through the use of a commercially available full-wave electromagnetic simulation software such as Ansoft HFSS 3D structure electromagnetic field simulator, which is provided by the Ansoft Company of Pittsburgh, Pa. Desirably, the candidate electromagnetic simulator is capable of finite element analysis of three-dimensional structures having finite conductivity.

The shape of conductive element 220 can also be influenced by the desire to dissipate excess heat from each of solid-state amplifier devices 210. Conductive element 220 generally includes a metallic surface having an area larger than that present in conventional power combiners, such as a Wilkinson power combiner. This feature can be especially useful in power amplifier circuits biased for class "A" operation where a current continuously flows through each of solid-state amplifier devices 210, thus requiring a design capable of removing an ample amount of excess heat. The superior heat dissipation properties of conductive element 220 also produces the desirable effect of increasing the reliability of solid-state amplifier devices 210 by enabling these to operate at the lowest possible temperature.

Although not shown in FIG. 1, conductive element 220 can also be interfaced directly to the voltage source used to provide primary direct current power to each of solid-state amplifier devices 210. In this case, the broad conductive attribute of conductive element 220 provides a low-resistance path which minimizes the heat generated by the presence of excess direct current, and improves the overall amplifier circuit efficiency.

As shown in FIG. 1, a plurality of planar grooves (250) is present within conductive element 220. In FIG. 1, each of planar grooves 250 is inclined from wide end portion 230 toward narrow end portion 240. This provides a guiding metallized structure between adjacent ones of planar grooves 250 allowing propagation of the output signal from each of solid-state amplifier devices 210 toward output transmission line 260. In a preferred embodiment, each of planar grooves 250 partially or completely incorporates a resistive material. The resistive material provides a degree of circuit isolation between adjacent ones of coupling paths 235. Through the use of resistive material within planar grooves 250, any oscillations caused by amplitude imbalances between any of coupling paths 235 can be damped. Additionally, the use of resistive material avoids cross moding in which a standing wave is formed across the length of wide end portion 230.

Planar grooves 250 can incorporate an air medium 251 interspersed within the resistive material. Desirably, the air medium 251 is interspersed within each of planar grooves 250 in the vertical dimension parallel to wide end portion 230 of FIG. 1. The use of an air material interspersed within the resistive material allows cross modal standing waves along the length of wide end portion 230 to be damped, while transverse modal standing waves, which extend from wide end portion 230 to narrow end portion 240, are not absorbed. This feature can impart additional efficiency to the structure of FIG. 1 by resistively damping only those standing waves which cause undesirable charge pumping across the length of wide end portion 230 while discouraging the absorption of energy traveling in the transverse direction from wide end portion 230 to narrow end portion 240.

The general shape of planar grooves 250 is shown to be that of a sinusoid which follows a meandering course. However, the actual shape of each of planar grooves 250 is expected to be the result of the electromagnetic simulation as is used to determine the shape of conductive element 220. One constraint on this simulation is the desire to equalize lengths of each of coupling paths 235. Additionally, the actual inclination and sinusoidal period of each of planar grooves 250 is also the subject of this type of simulation.

Figure 2:
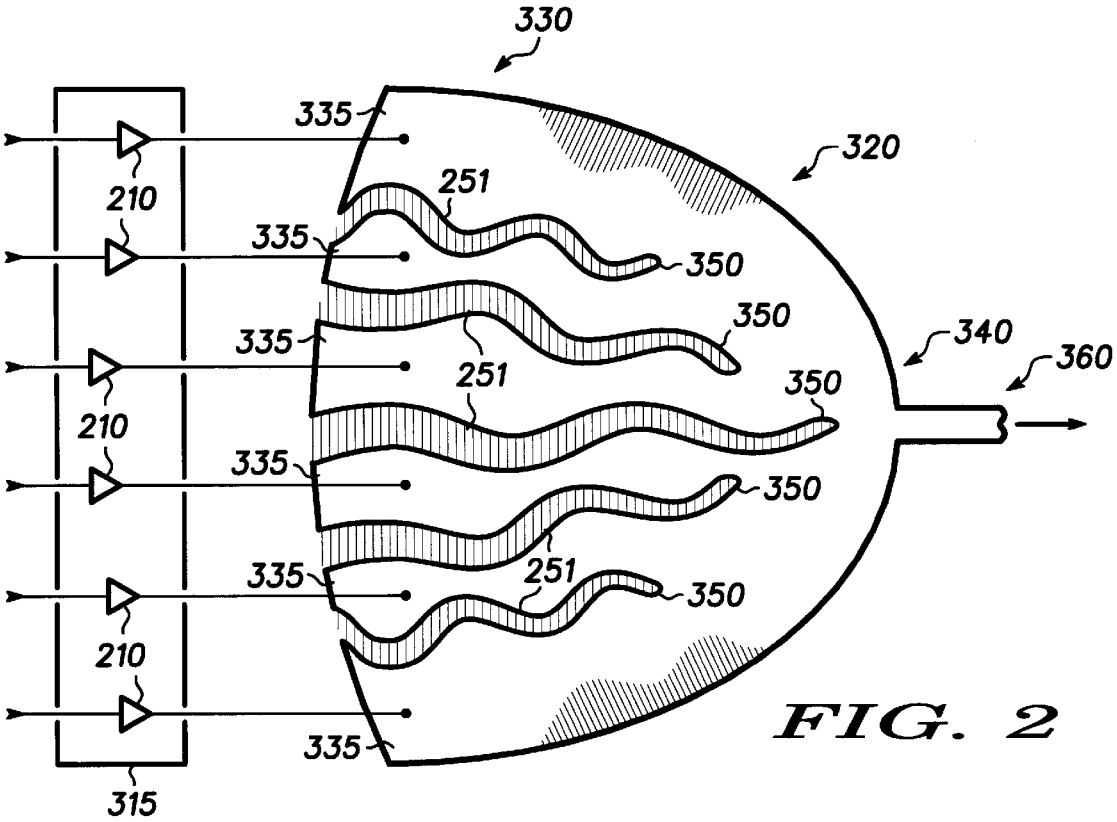
FIG. 2 shows the high frequency low loss power combining structure of FIG. 1 as well as the electrically equidistant placement of solid-state power amplifier elements which feed the power combining structure in accordance with a preferred embodiment of the invention.

FIG. 2 shows the high frequency low loss power combining structure of FIG. 1 and the physical placement of solid-state power amplifier elements which feed the power combining structure in accordance with a preferred embodiment of the invention. The overall shape of conductive element 320 (similar to conductive element 220) is shown to be that of a parabola, in accordance with the results of an electromagnetic simulation. The parabolic shape of conductive element 320 includes wide end portion 330 and narrow end portion 340, which are similar to wide end portion 230 and narrow end portion 240, respectively, of FIG. 1.

As previously mentioned in reference to planar grooves 250 of FIG. 1, the general shape of each of planar grooves 350 is shown to be that of a meandering sinusoid which may result from the use of an electromagnetic simulation. Similar to that mentioned in reference to planar grooves 250, planar grooves 350 incorporate an air medium 251 interspersed within the resistive material in the vertical dimension parallel to wide end portion 330. The use of an air material interspersed within the resistive material allows cross modal standing waves along the length of wide end portion 330 to be damped, while transverse modal standing waves, which extend from wide end portion 330 to narrow end portion 340, are not absorbed. This brings about additional efficiency to the structure of FIG. 2 by resistively damping only those standing waves which cause undesirable charge pumping across the length of wide end portion 330 while discouraging the absorption of energy traveling in the transverse direction from wide end portion 330 to narrow end portion 340.

An additional constraint on the electromagnetic simulation used to arrive at the parabolic shape of conductive element 320 is the desire to equalize the lengths of each of coupling paths 335, which are similar to coupling paths 235 of FIG. 1. As shown in FIG. 2, wide end portion 330 can be shaped in accordance with a section of a circle in order to provide substantially identical lengths of each of coupling paths 335. Additional equalization in the electrical distance from each of solid-state amplifier devices 210 can be achieved by arranging the devices on die 315, as shown in FIG. 2. Thus, the placement of each of solid-state amplifier devices 210 allows for an additional degree of freedom in synchronizing the phase front of the signals from each of devices 210 so that all phase fronts simultaneously impinge upon narrow end portion 340 in order to be uniformly coupled to output transmission line 360, thus minimizing any phase distortions.

In conclusion, a high frequency low loss power combiner enables the efficient power combining of solid-state amplifier devices through the use of a substantially full metal jacket combining structure. The structure incorporates a wide end portion which presents a group of low impedance coupling paths suitable for coupling to a corresponding solid-state amplifier device. Power from each amplifier device is combined at a narrow end portion and conveyed to a transmission line. The power combiner requires minimal integrated circuit chip area and can be designed and fabricated using existing microstrip analysis and design tools. Additionally, the substantially full metal jacket structure provides a low-resistance path for supplying direct current primary power to the amplifier devices, thereby increasing overall device efficiency. Further, the substantially full metal jacket structure provides additional excess heat dissipation through increased surface area of the conductive metallized structure over that of the Wilkenson power combiner.

The foregoing description of the specific embodiments will so fully reveal the general nature of the invention that others can, by applying current a knowledge and design tools, readily modify and/or adapt for various applications such specific embodiment without departing from the generic concept, and therefore such adaptations and modifications should and are intended to be comprehended within the meaning and range of equivalents of the disclosed embodiments.

It is to be understood that the phraseology or terminology employed herein is for the purpose of description and not limitation. Accordingly, the invention is intended to embrace all such alternatives, modifications, equivalents and variations as fall within the true spirit and broad scope of the appended claims.

What is claimed is:

1. A power combiner for use at high frequencies, comprising:

a dielectric layer;

a conductive element affixed to said dielectric layer, said conductive element being substantially planar and a conic shape, wherein a wide end portion of said conic shape provides a plurality of inputs and wherein a narrow end portion of said conductive element functions as an output;

a plurality of substantially planar grooves distributed within said conductive element, at least one of said plurality of substantially planar grooves incorporating a resistive material; and an outer perimeter of said conductive element from said wide end portion to said narrow end portion to said wide end portion is approximately one half of the wavelength of a frequency of operation of said power combiner.

2. The power combiner of claim 1, wherein said conic shape is a parabola.

3. The power combiner of claim 1, wherein a distance along an outer perimeter from said wide end portion to said narrow end portion of said conductive element is approximately one quarter of the wavelength of a frequency of operation of said power combiner.

4. The power combiner of claim 1, wherein said wide end portion is shaped in accordance with a section of a circle.

5. The power combiner of claim 1, wherein each of said plurality of substantially planar grooves is tapered from said wide end portion of said conductive element toward said narrow end portion of said conductive element.

6. The power combiner of claim 5, wherein each of said plurality of substantially planar grooves follows a meandering course.

7. The power combiner of claim 5, wherein an air medium is interspersed within said resistive material.

8. A power amplifier circuit for use with a communications unit comprising:

a dielectric layer;

a conductive element affixed to said dielectric layer, said conductive element being substantially planar and a conic shape, wherein a wide end portion of said conic shape provides a plurality of inputs and wherein a narrow end portion of said conductive element functions as an output;

a plurality of substantially planar grooves distributed within said conductive element, at least one of said plurality of substantially planar grooves incorporating a resistive material; and an outer perimeter of said conductive element from said wide end portion to said narrow end portion to said wide end portion is approximately one half of the wavelength of a frequency of operation of said power combiner.

* * * * *